United States Patent [19]

Liu

[11] Patent Number: 5,054,848

[45] Date of Patent: Oct. 8, 1991

[54] FOLDING CHAIR FRAME TUBE POSITIONING DEVICE

[76] Inventor: Chung-Hsin Liu, No. 6, Lane 46, 20 Chang Rd, Chang Ling Li, Hsin Tien City, Taipei, Taiwan

[21] Appl. No.: 574,034

[22] Filed: Aug. 29, 1990

[51] Int. Cl.[5] ..... A47C 4/00

[52] U.S. Cl. ..... 297/39; 297/16; 403/92

[58] Field of Search ..... 297/16, 39, 46, 35, 297/24; 403/85, 92, 101

[56] References Cited

U.S. PATENT DOCUMENTS

| | | | |
|---|---|---|---|
| 2,857,086 | 9/1958 | Weiner | 297/39 |
| 2,957,516 | 10/1960 | Kubisz | 297/39 X |
| 3,279,734 | 10/1966 | Kramer | 297/39 X |
| 4,536,026 | 8/1985 | Cornell | 297/39 |
| 4,772,068 | 9/1988 | Gleckler et al. | 297/39 |
| 4,963,762 | 10/1990 | Brooks | 297/39 X |

*Primary Examiner*—Peter R. Brown

*Attorney, Agent, or Firm*—Varndell Legal Group

[57] ABSTRACT

Disclosed is a folding chair frame tube positioning device, which is comprised of a pivot device and a coupling buckle to releasably secure the back frame and the back stand of the chair together. The pivot device comprises a transverse axle secured to the lower end of the back frame at an outer side and two parallel plates vertically extending downward therefrom to pivotably bilaterally connect to the middle part of a back stand. The coupling buckle comprises a ring-shaped portion sleeved on the back stand, and an unitary side projection having a retaining notch on the bottom for engaging with the transverse axle of the pivot device.

1 Claim, 4 Drawing Sheets

FOLDING CHAIR FRAME TUBE POSITIONING DEVICE

BACKGROUND OF THE INVENTION

The present invention is related to folding chairs and more particularly to a folding chair frame tube positioning device to firmly secure the frame tubes of a folding chair in position.

Folding chair is a collapsible chair which can be folded up to minimize space occupation when not in use. A folding chair is generally comprised of a frame tube for the front stand, a frame tube for the back stand, a frame tube for the seat and a frame tube for the back. All the frame tubes are respectively collapsibly connected together by means of rivet joint. One disadvantage of the afore-said conventional folding chair is that the folding chair does not have any retainer means to secure the positioning of the back stand relative to the seat. If a folding chair is shaken by force while one is lying or sitting thereon, the positioning of the back stand relative to the seat may be changed easily and the front stand of a folding chair may be lifted from the ground to cause a folding chair to fall backward to the ground. Because the frame tubes are connected together through rivet joint, one's fingers or skin may be pinched easily during operation or while sitting.

SUMMARY OF THE INVENTION

It is an object of the present invention to provide a folding chair frame tube positioning device which can firmly secure the frame tubes of a folding chair in position.

It is another object of the present invention to provide a folding chair frame tube positioning device which can stabilize the-positioning of a folding chair to support a heavy load and prevent from injury during use.

It is still another object of the present invention to provide a folding chair frame tube positioning device which is simple in structure and inexpensive to manufacture.

According to the present invention, a folding chair frame tube positioning device is comprised of a pivot device and a coupling buckle. The pivot device is pivotably connected between the lower end of the back frame tube and the middle part of the back stand frame tube of the chair. The coupling buckle is sleeved on the back stand frame tube to releasably engage with the upper end of the pivot device so as to firmly secure the back frame tube to the back stand frame tube.

DETAILED DESCRIPTION OF THE PREFERRED EMBODIMENTS

Figure 1:
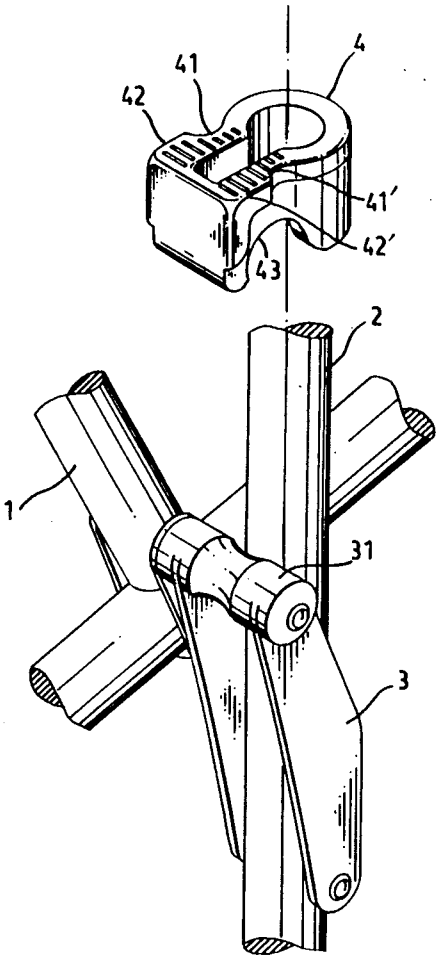
FIG. 1 is a perspective fragmentary view of the present invention.
Figure 4:
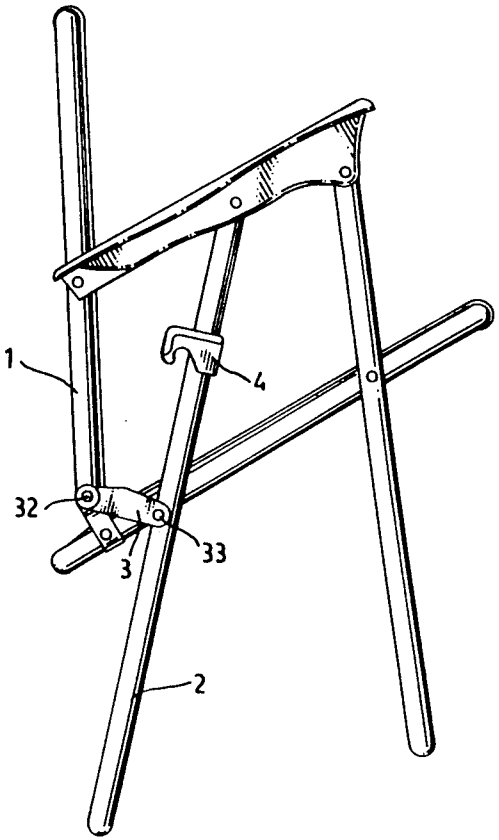
FIG. 4 is a schematic drawing, illustrating a condition of the present invention when the chair is folding to collapse.

Referring to FIGS. 1 through 4, a folding chair frame tube positioning device of the present invention is generally comprised of a pivot device 3 and a coupling buckle 4. As illustrated, the pivot device 3 comprises a transverse axle 31 secured to the lower end of a back frame tube 1 at an outer side by a bolt (or rivet) 32, and two parallel plates vertically extending downward therefrom to pivotably bilaterally connect to the middle part of a back stand frame tube 2 by a bolt (or rivet) 33. The coupling buckle 4 is sleeved on the back stand frame tube 2 to releasably secure the transverse axle 31 to the back stand frame tube 2. As illustrated in FIG. 1, the coupling buckle 4 comprises a C-shaped ring portion designed in size according to the outer diameter of the back stand frame tube 2 and incorporated with two wing ribs 42, 42' at ends 41, 41'. The two wing ribs 42, 42' are closed at an outer side and define an arch-shaped retaining notch 43 at the bottom.

Figure 2:
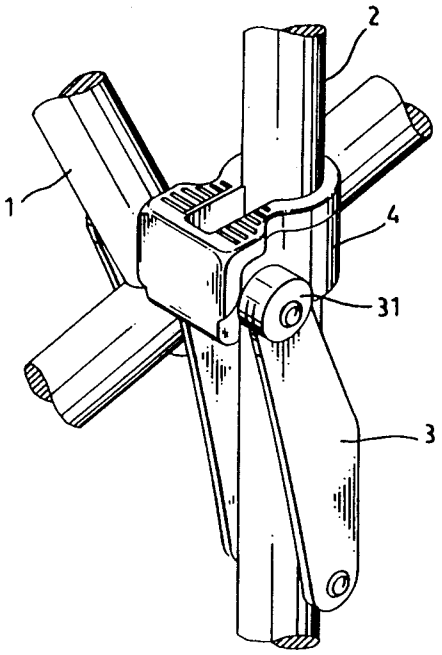
FIG. 2 is a perspective assembly view thereof.
Figure 3:
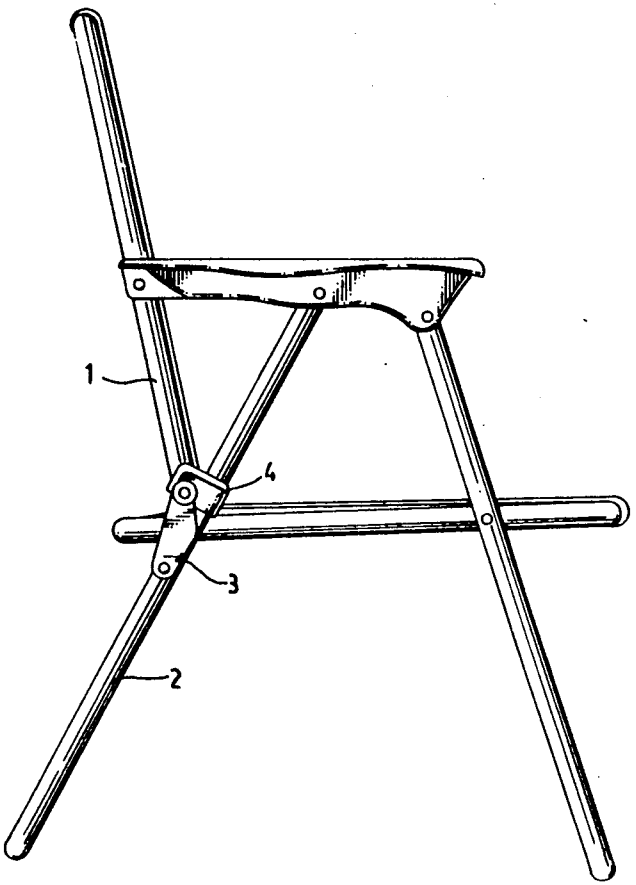
FIG. 3 is a schematic drawing, illustrating the operation of the present invention when the chair is in an expanded condition.

After the C-shaped ring portion of the coupling buckle 4 is sleeved on the back stand frame tube 2, the coupling buckle 4 can be simply pressed down to force its retaining notch 43 to engage with the transverse axle 31 of the pivot device 3 so as to firmly secure the back frame tube 1 and the back stand frame tube 2 together (see FIGS. 2 and 3).

When a folding chair of the present invention is set in an expanded condition as shown in FIG. 3, the back stand frame tube 2 is disposed at a certain angle of inclination (for example, 10 relative to the ground to define a contained angle with the back frame tube 1 which is over 90. Once there is somebody sitting on the chair, the heavy body weight may force the back frame tube 1 and the back stand frame tube 2 to increase the contained angle 0. Because of the effect of the coupling buckle 4, the backward force from one's back will simultaneously force the frame tubes 1 and 2 to increase the contained angle 0. Therefore, by means of the restraint of the coupling buckle 4 with the pivot device 3, the chair can be stably positioned at a place. When to collapse the chair, the pivot device 4 is simply moved upward to disengage from the pivot device 3 so that the pivot device 3 can be rotated on the bolt 32 or 33 permitting the back frame tube 1 and the back stand frame tube 2 to be folded up together.

Figure 5:
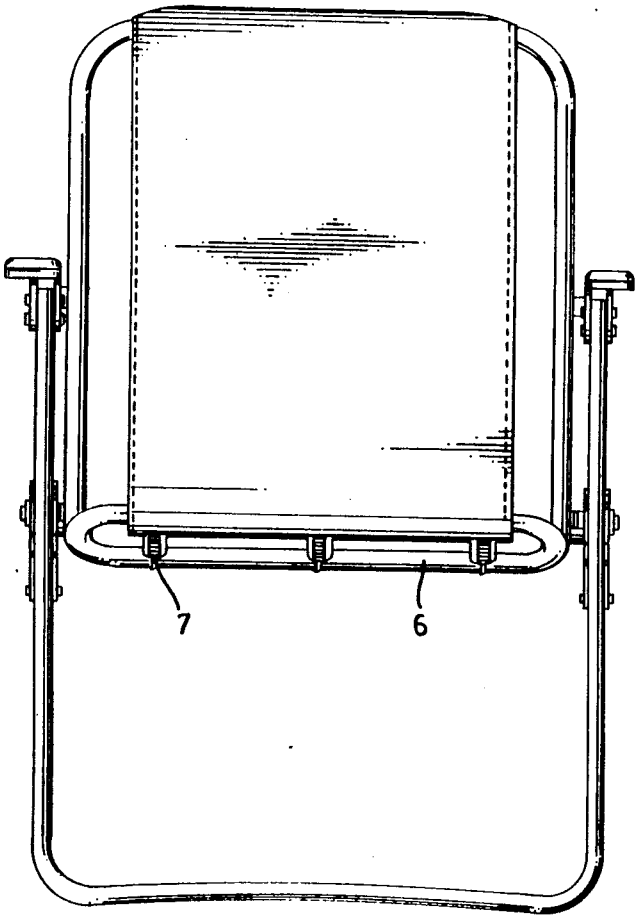
FIG. 5 illustrates the locations of tension springs on a folding chair according to the present invention.
Figure 7:
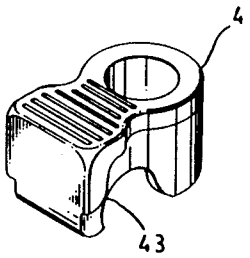
FIG. 7 illustrates an alternate form of coupling buckle according to the present invention.
Figure 6:
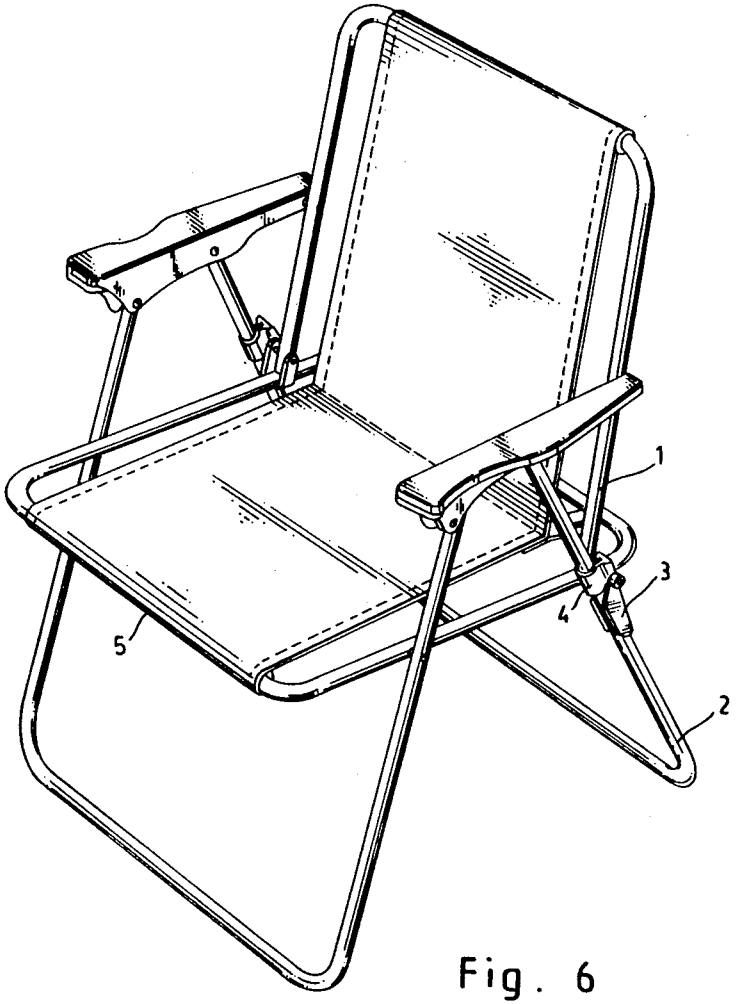
FIG. 6 is a perspective view of a folding chair constructed according to the present invention.

Referring to FIG. 5, tension springs 7 may be secured between the seat leather 5 and the seat frame at the back side to stretch the seat leather 5 in shape.

I claim:

1. A folding chair frame tube positioning device, comprising a pivot device having a transverse axle secured to the lower end of a back frame tube at an outer side, and two parallel plates vertically extending downward therefrom to pivotably bilaterally connect to the middle part of a back stand frame tube; and a coupling buckle having a C-shaped ring portion sleeved on said back stand frame tube and incorporated with two side projections, said two side projections being closed at an outer side and defining an arch-shaped retaining notch at the bottom for engaging with said transverse axle to firmly secure said back frame tube to said back stand frame tube.

* * * * *